US012037902B2

(12) United States Patent
Javed et al.

(10) Patent No.: US 12,037,902 B2
(45) Date of Patent: Jul. 16, 2024

(54) METHODS AND SYSTEMS OF A COMBO TOOL FOR SAMPLING WHILE LOGGING (SWL)

(71) Applicant: SAUDI ARABIAN OIL COMPANY, Dhahran (SA)

(72) Inventors: Muhammad Imran Javed, Abqaiq (SA); Sanjiv Kumar, Udhailiyah (SA); Mohammed N. Almannai, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/049,962

(22) Filed: Oct. 26, 2022

(65) Prior Publication Data

US 2024/0141782 A1 May 2, 2024

(51) Int. Cl.
*E21B 49/10* (2006.01)
*E21B 49/08* (2006.01)

(52) U.S. Cl.
CPC ..... *E21B 49/10* (2013.01); *E21B 49/084* (2013.01); *E21B 49/0875* (2020.05)

(58) Field of Classification Search
CPC .... E21B 49/084; E21B 49/10; E21B 49/0875; E21B 49/088; E21B 49/087
See application file for complete search history.

(56) References Cited

U.S. PATENT DOCUMENTS 3,437,138 A * 4/1969 Scott ..... E21B 49/081 166/162
4,842,064 A * 6/1989 Gazda ..... E21B 47/06 166/250.07
7,621,325 B2 * 11/2009 Shammai ..... E21B 49/10 166/264
9,429,014 B2 * 8/2016 Villareal ..... E21B 49/086
10,132,159 B2 * 11/2018 Burgos ..... E21B 47/06
10,539,015 B2 * 1/2020 Nguyen-Thuyet .... E21B 49/088
10,738,607 B2 8/2020 Proett et al.
(Continued)

FOREIGN PATENT DOCUMENTS

WO 2021135036 A1 7/2021

OTHER PUBLICATIONS

F. G. Sanchez et al.; "Fluid Analysis and Sampling: The Next Big Step for Logging While Drilling Tools", SPE 152223; Society of Petroleum Engineers; Apr. 2012; pp. 1-19 (19 pages).

*Primary Examiner* — Shane Bomar
(74) *Attorney, Agent, or Firm* — Osha Bergman Watanabe & Burton LLP

(57) ABSTRACT

A sample while logging tool for downhole fluid sampling and production logging may include a sample collector sub and a sensor sub. The sample collector sub may include a body defining a bore extending from a first end to a second end. One or more sample chambers may be housed in the bore. The sample chamber may collect a fluid sample. At least one probe may be coupled to the sample chamber to measure fluid properties of the collected fluid sample within the sample chamber and transmit the fluid properties. A piston may be coupled to the first end having a gate distal to the first end. The piston may be actuated to open and close an opening of the sample chamber. Additionally, the sensor sub may measure and transmit data on fluids within a well to form production logging data.

17 Claims, 7 Drawing Sheets

(56) References Cited

U.S. PATENT DOCUMENTS

| | | | | |
|---|---|---|---|---|
| 2002/0043620 | A1* | 4/2002 | Tchakarov | G01N 21/3504 250/269.1 |
| 2009/0250214 | A1 | 10/2009 | Simpson | |
| 2014/0182836 | A1 | 7/2014 | Irani et al. | |
| 2014/0278113 | A1* | 9/2014 | Chok | E21B 49/088 702/12 |
| 2020/0003054 | A1* | 1/2020 | Yuratich | E21B 49/08 |
| 2021/0164342 | A1* | 6/2021 | Jones | E21B 49/088 |

* cited by examiner

METHODS AND SYSTEMS OF A COMBO TOOL FOR SAMPLING WHILE LOGGING (SWL)

BACKGROUND

In the oil and gas industry, operations may be performed in a wellbore at various depths below the surface. During wellbore operations, logging may be conducted to collect data from the wellbore. Logging operations are typically used to characterize the wellbore, formation, and fluids prior to well completion; however, a number of logging tools are available to provide information during production operations when fluids are being produced from a well. Production logging may be used to evaluate fluid movement in and out of wellbores, quantify flow rates and determine fluid properties at downhole conditions.

Additionally, fluid sampling operations are a frequency-based survey that is done with the aim to analyze produced/injected fluids for fluid/formation evaluation purposes. Fluid sampling can provide numerous fluid/formation parameters such as salt content, water cut, sediment content, change in formation water composition (caused by casing leaks and behind pipe water channeling), wellbore integrity, and scaling tendency. These fluid/formation parameters are only a few examples of a plethora of parameters that fluid samples can introduce which ultimately will help in data gathering, monitoring, and taking preventative actions when needed.

Conventionally, production logging operations and fluid sampling operations are conducted separately as production logging tools can only collect data without fluid sampling. In conventional methods, a production logging tool run is done individually followed by a fluid sampling run. For example, production logging operations are conducted, and the data is analyzed. After the data analyzed, well intervention and fluid sampling are conducted after the production logging operations to collect bottom hole reservoir fluid samples for further analyses. These conventional methods of separately conducting production logging operations and fluid sampling operations entails more operational time which ultimately translates to less operational efficiency and increased cost.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a sample while logging tool for downhole fluid sampling and production logging. The sample while logging tool may include a sample collector sub that includes a body defining a bore extending from a first end to a second end; one or more sample chambers housed in the bore, the sample chamber is configured to collect a fluid sample; at least one probe coupled to the sample chamber to measure fluid properties of the collected fluid sample within the sample chamber and transmit the fluid properties; and a piston coupled to the first end having a gate distal to the first end, the piston is actuated to open and close an opening of the sample chamber. Additionally, a sensor sub may be coupled to the sample collector sub and configured to measure and transmit data on fluids within a well to form production logging data. The sensor sub may include at least one gamma ray sensor, pressure sensor, temperature sensor, fluid density sensor, or casing collar locator sensor.

In another aspect, the embodiments disclosed herein relate to a system that may include a wellhead on a surface of a wellbore; a wireline extending downward into the wellbore from the wellhead; and a bottom hole assembly coupled to a lowermost end of the wireline. The bottom hole assembly may include a connector coupled to the wireline; a sample collector sub, the sample collector sub includes one or more sample chambers, at least one probe coupled to the sample chamber, and a piston operationally coupled to the sample chamber, the piston is configured to open and close an opening of the sample chamber; the sample collector sub collects a well fluid sample; and a sensor sub coupled to the sample collector sub, the sensor sub may include at least one gamma ray sensor, pressure sensor, temperature sensor, fluid density sensor, or casing collar locator sensor, the sensor sub measures and transmits data on fluids within the wellbore to form production logging data.

In yet another aspect, the embodiments disclosed herein relate to a method for using a sample while logging tool. The method may include conducting production logging operations with the sample while logging tool in a wellbore; actuating a piston within the sample collector sub of the sample while logging to axially move downward; covering an opening of a sample chamber of the sample collector sub with a gate coupled to the piston to form a differential pressure between an atmospheric pressure in the sample chamber and a bottomhole pressure in the wellbore; flowing well fluids into the opening and filling the sample chamber with the well fluids; transmitting a signal, with at least one probe coupled to the sample chamber, indicating the sample chamber is filled; further actuating the piston to move past the sample chamber to close the opening; and retrieving the sample chamber at the surface to collect the well fluids.

Other aspects and advantages will be apparent from the following description and the appended claims.

BRIEF DESCRIPTION OF DRAWINGS

Embodiments of the present disclosure will now be described in detail with reference to the accompanying Figures. Like elements in the various figures may be denoted by like reference numerals for consistency.

DETAILED DESCRIPTION

Figure 1:
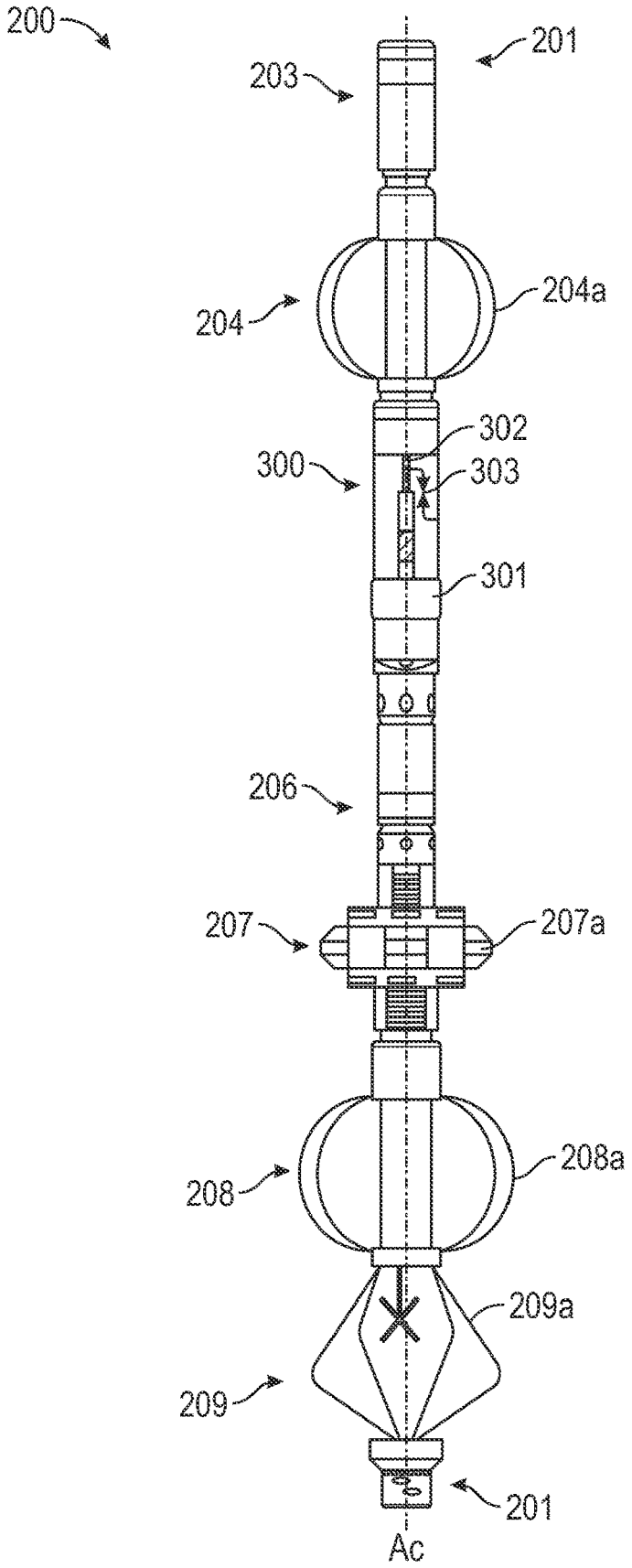
FIG. 1 shows a schematic diagram of a sample while logging (SWL) tool in accordance with one or more embodiments.

In the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" "attached" or "attached to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification. In addition, any terms designating tubular (i.e., a length of pipe that provides a conduit through which oil and/or gas may be produced) should not be deemed to limit the scope of the disclosure. The tubular may be connected to other tubulars to from a tubular string. As used herein, fluids may refer to slurries, liquids, gases, and/or mixtures thereof. The embodiments are described merely as examples of useful applications, which are not limited to any specific details of the embodiments herein.

Embodiments disclosed herein relate generally to a sample while logging (SWL) tool to conduct production logging operations and fluid sampling operations in a single run. More specifically, a sampling compartment and a production logging tool are combined and provided on the same tool string. Additionally, the sampling compartment may include an electrically controlled piston to selectively open and close to collect samples. Further, the sampling compartment may also include electrical probes to transmit data to the surface to ensure the fluid sample being collected matches the fluids being logged by the SWL tool. In some embodiments, the SWL tool is a part of a bottom hole assembly (BHA) attached to an end of a production string that will reach the furthest depth in a wellbore.

The SWL tool may facilitate running both sampling operations and production logging operations simultaneously to enable a user to selectively sample any interval of interest downhole. Overall, the SWL tool as described herein may reduce product engineering, reduce of assembly time, reduce hardware cost, and/or reduce weight and envelope. The one or more embodiments, a method of simultaneously conducting sampling operations and production logging operations with the SWL tool results in a reduction of operational time by only requiring a single run downhole, and decreases a cost of mobilization, rig up, and job execution associated with conventional production logging operations and fluid sampling operations.

Referring to FIG. 1, in one or more embodiments, a close-up view of a sample while logging (SWL) tool 200 is illustrated. The SWL tool 200 is formed by a string of tools interconnected end-to-end together. For example, from an upper most end 201 to a lower most end 202, the SWL tool 200 includes a connector 203, a first centralizer 204, a sample collector sub 300, a sensor sub 206, a flowmeter 207, a second centralizer 208, and a spinner 209. The assembly of the SWL tool 200 minimizes overlapping effects across the various tools within the SWL tool 200. Overall, the SWL tool 200 may allow a user to simultaneously collect fluid samples and conduct production logging at any interval of interest in a wellbore. By collecting fluid samples and conducting production logging, the SWL tool 200 enables a user to selectively fluid sample to determine sand sizes from an area of interest to aid in creating an efficient gravel pack system accommodating the formation sand production. In addition, accurate salinity determination is achieved with the SWL tool 200 since selectively sampling an area of interest provides an accurate representation of salinity. Furthermore, the SWL tool 200 may also monitor chemical compositions to identifying cross-communications, integrity issues, and other fluid and formation properties. It is further envisioned that the SWL tool 200 may collect fluid samples without any time lapse to provide more accurate measurement and analysis for data matching to the fluids being logged.

The connector 203 may be any type of connection end to allow the SWL tool 200 to be coupled to a cable, such as a wireline, slickline, coiled tubing, or electric line. For example, the connector 203 may be a rope socket connector for the cable to run through a top of the rope socket connector and be locked within the rope socket connector. The rope socket connector may be a wedge type, spool type, split type, camp type or a releasable type of rope socket connector.

The first centralizer 204 and the second centralizer 208 may both include stabilizer blades 204*a*, 208*a*. The stabilizer blades 204*a*, 208*a* extend radially outward from a central axis Ac of the SWL tool 200. The stabilizer blades 204*a*, 208*a* may contact a wellbore or a casing to make the SWL tool 200 coaxial with a wellbore.

The sample collector sub 300 to collect a fluid sample within the wellbore (6). The sample collector sub 300 includes one or more sample chambers 301 operationally coupled to a piston 302. The piston 302 may axially move upward and downward to selectively open and close the sample chamber 301 to collect fluids from wellbore. In some embodiments, a length of the piston 302 and the sample collector sub 300 may be extended to hold a plurality of sampling chambers (301). Further, a movement of the piston 302 may be restricted to a specific depth under a pre-determined voltage to ensure that only one sampling chamber (301) is opened at a time for that pre-determined voltage. Once a second sampling chamber (301) is required to be opened, a second pre-determined voltage may be induced to continue the movement of the piston 302 and open the second sampling chamber (301). Additionally, the sample collector sub 300 includes at least one probe 303 to transmit data to the surface via the cable.

The sensor sub 206 may measure and transmit data on fluids within the wellbore (6) to form the production logging data. Additionally, the sensor sub 206 may include a plurality of sensors to measure (i.e., log) downhole conditions and transmit the data the surface via the cable. For example, the plurality of sensors may include at least one gamma ray sensors, pressure sensors, temperature sensors, fluid density (radioactive or inertial) sensors, casing collar locator (CCL) sensors, or other type of sensors used in production logging operations.

The flowmeter 207 may be an inline flowmeter to measure a flow rate within the wellbore (6). The inline flowmeter may measure a flow rate and a volume of fluid flowing through a bore 207*a* of the flowmeter 207.

The spinner 209 may measure a flow along the wellbore. The spinner 209 may be fan blade type device 209*a* that is rotated by fluid movement in the wellbore. The spinner 209 may be a small diameter type continuous flowmeter, a full-bore type continuous flowmeter, or a diverter type flowmeter.

Figure 2:
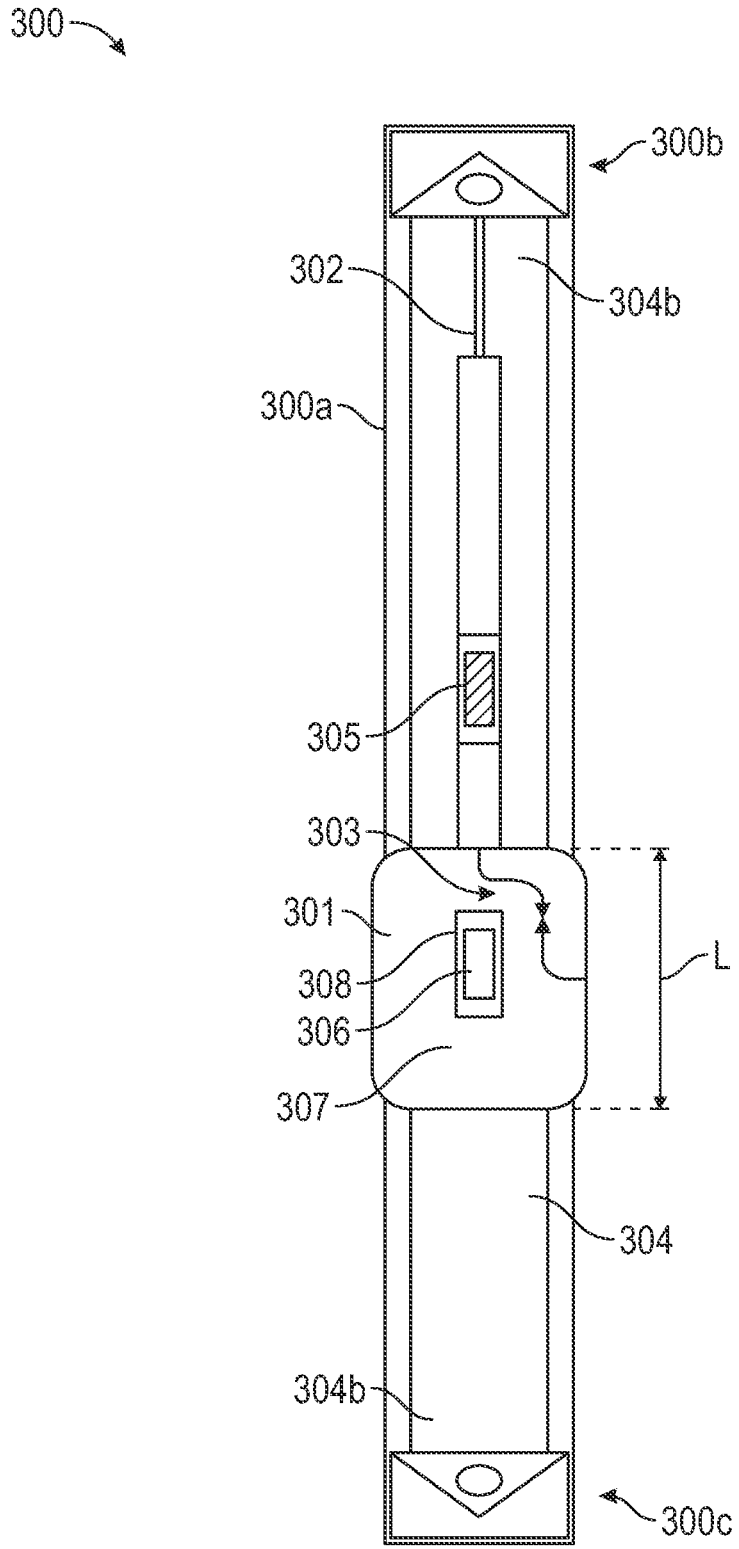
FIG. 2 shows a close-up view of a sample collector sub of the SWL tool of FIG. 1 in accordance with one or more embodiments.

Now referring to FIG. 2, in one or more embodiments, a close-up view of the sample collector sub 300 is illustrated. The sample collector sub 300 is formed by a body 300*a* extending from a first end 300*b* to a second end 300*c*. the first end 300*b* and the second end 300*c* are connection ends such as threaded connections with electric connections to couple the sample collector sub 300 to other components in the SWL tool 200.

The body 300*a* defines a bore 304 separated into a first hollow zone 304*a* and a second hollow zone 304*b* by the sample chamber 301. The first hollow zone 304*a* may be axially longer than the second hollow zone 304*b* based on the position of the sample chamber 301. The sample chamber 301 may be a housing extending a length L of the body 300*a* to hold a volume of fluids form the wellbore. In some embodiments, the sample chamber 301 may have a volume of at least 1 liter for fluid collecting. Additionally, the sample chamber 301 is removably coupled within the body 300*a* with mechanical fasteners. By having the sample chamber 301 removable, fluid samples within the sample chamber 301 avoid being compromised once the operation is conducted so that the sample chamber 301 may be transported to a lab without contamination from being opened. Moreover, the mechanical fastener does not intersect within the sample chamber 301 to avoid contacting the collected fluid sample. The sample chamber 301 may have an opening 306 on an outer surface 307 of the housing. Additionally, a sealing element 308, such as an elastomer seal or O-ring, is part of the sample chamber assembly. The seal ensures fluids do not leak into the free space (e.g., the first hollow zone 304*a* and the second hollow zone 304*b*) inside the sample collector sub 300 and obstruct a movement of the piston 302. It is further envisioned that the sample chamber 301 may include a drain port (not shown) to remove the collected fluid sample. The drain port may have a check valve with a sealing element (i.e., O-ring) to maintain the collected fluid sample inside and under pressure conditions.

In some embodiments, at least one probe 303 is provided on the outer surface 307 of the housing. Additionally, the probe 303 may have an insulated cover to isolate the probe 303 from environmental elements such as heat and liquids. Further, by having the probe 303 on the outer surface 307, the probe 303 may be repaired or replaced without having to remove the sample chamber 301 from the body 300*a*. The probe 303 may measure the fluids in the sample chamber 301 as well as measure a depth of the sample collector sub 300. The probe 303 may transmit the data through the piston to the electric connections of the first end 300*b* to then be sent the surface via the cable. The transmitted data from the probe 303 is cross correlated to the fluid being logged by the sensor sub 206, the flowmeter 207, and the spinner 209 to ensure that the fluid being collected in the sample chamber 301 is the same fluid being logged.

Still referring to FIG. 2, the piston 302 may have a first end coupled to the first end 300*b*. Additionally, a gate 305 may be coupled to the piston 302 at an end distal the first end 300*b*. The piston 302 is initially deployed in a first position within the first hollow zone 304*a* such that a gate 305 is above the sample chamber 301. Additionally, the piston 302 may be electrically controlled via the electric connections of the first end 300*b*. For example, a predetermined voltage is induced by sending electricity from the surface down the cable to reach the piston 302 via the electric connections of the first end 300*b*. In some embodiments, the predetermined voltage may be based on a depth at which the fluid sample is collected (i.e., a length from the depth to surface affects the resistance of the current itself). For example, the predetermined voltage may be 220-300 volts. The predetermined voltage actuates the piston 302 to the gate 305 into the sample chamber 301. The gate 305 moves the opening 306 of the sample chamber 301 to an open position to receive fluids from the wellbore. More specifically, the opening gate of the piston tool comes in front of the opening window of the sample and due to atmospheric and bottom hole pressure differential, the fluid will rush to fill the chamber immediately. Further to the downward movement of the piston, the opening gate will move down further and chamber opening window will then be sealed with the embedded elastomers seals.

Figure 3:
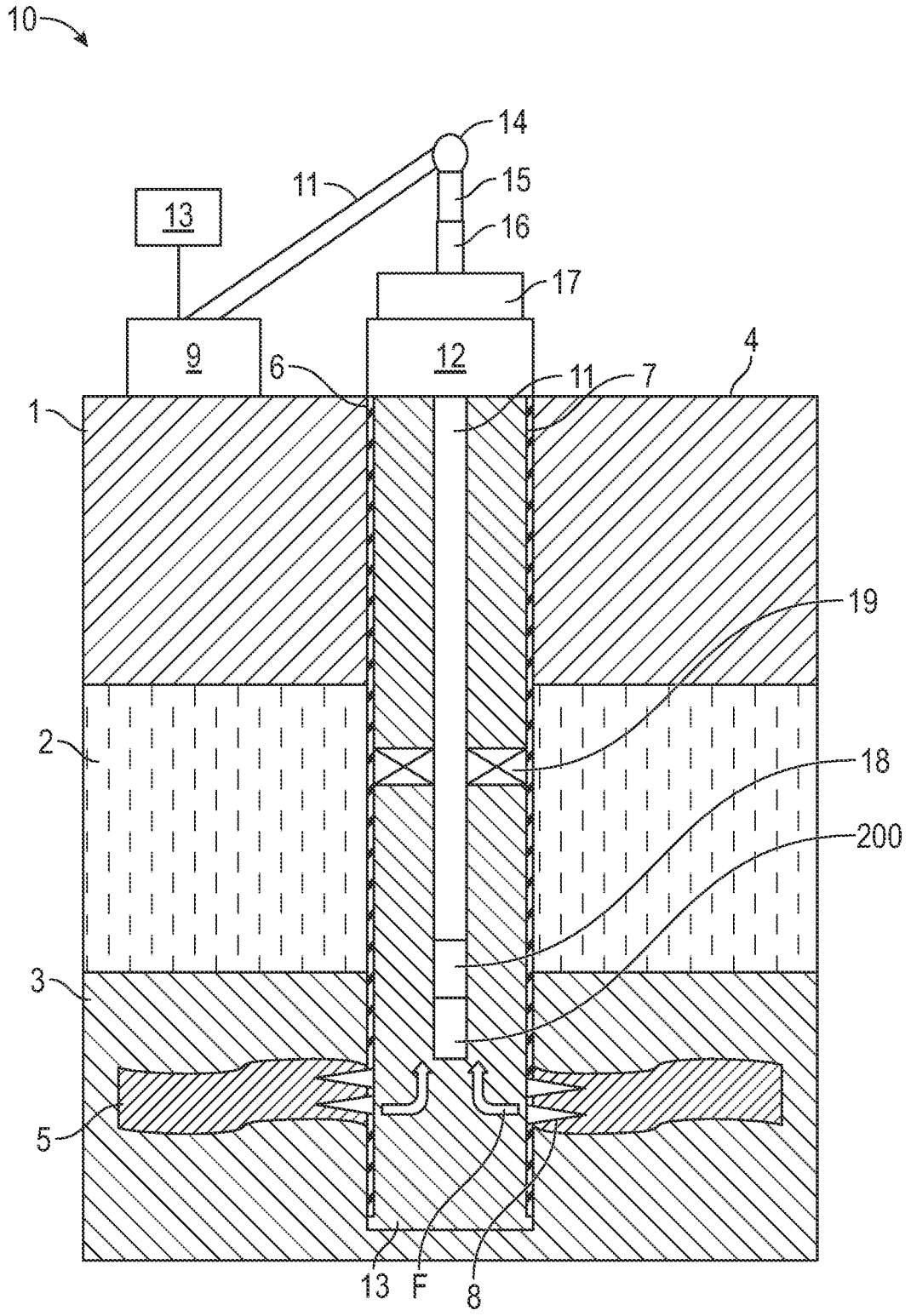
FIGS. 3-6 show examples of using the SWL tool of FIG. 1, in accordance with one or more embodiments of the present disclosure.

Now referring to FIGS. 3-6, in one or more embodiments, schematic diagrams of using the SWL tool 200 of FIG. 1 at a well site are shown. As shown in FIG. 3, a completion well system 10 for producing hydrocarbons according to one implementation is illustrated. For illustration purposes, subterranean formations 1, 2, 3 are shown below a surface 4. In general, there may be many layers of subterranean formations below the surface 4. For illustration purposes, subterranean formations 1, 2, 3 may be carbonate formations. In one example, formation 3 is a target reservoir 5 containing hydrocarbons to be produced. A wellbore 6, which is connected to the surface 4, may be drilled through the subterranean formations 1, 2, 3 to reach to the target reservoir 5. A casing 7 may be installed in wellbore 6. In some embodiments, the casing 7 may be perforated to have perforations 8 into the target reservoir 5 to allow a flow of hydrocarbons to enter the wellbore 6.

With the well completed, production logging operations may be conducted. For example, a cable unit 9 may be provided on the surface 4 to employ a cable 11 into the wellbore 6 via a wellhead 12 at the surface 4. The cable 11 may be a wireline, slickline, coiled tubing, or electric line running from the cable unit 9 through the wellhead 12 and into the wellbore 6. The cable 11 may be a multi-conductor, single conductor, braided, or fiber optic cables as a conveyance for the acquisition of subsurface data for a computer system 13 coupled, wirelessly or wired, to the cable unit 9 to analysis for subsurface geology, reservoir properties and production characteristics. Additionally, the cable unit 9 may be a truck or trailer having a drum to spool and unspool the cable 11.

To insert the cable 11 in the wellhead 12, the cable 11 must be vertically upright. To achieve a vertical upright position, the cable 11 is run through a sheave 14 axially above the wellhead 12. The sheave 14 receives the cable 11 at an angle and rotates the cable to be vertical upright. From the sheave 14, the cable 11 may enter a pressure control device 15 such as a stuffing box to contain well pressure while the cable 11 is either moving or stationary, while also being a guide for the cable 11. From the pressure control device 15, the cable 11 may enter a lubricator 16. The lubricator 16 is a long, high-pressure pipe fitted to the top of the wellhead 9 so that tools may be put into a high-pressure well. The lubricator 16 may include a high-pressure grease-injection section and sealing elements. As tools attached to the cable 11 are placed in the lubricator 16, the lubricator 16 is pressurized to wellbore pressure. Then the top valves of the wellhead 12 are opened to enable the tools to fall or be pumped into the wellbore 9 under pressure. From the lubricator 16, the cable enters a cable valve 17 on top of the wellhead 9. The cable valve 19 may be a wireline blind ram of a blowout preventer to close and seal around the cable 11 which allows operations to be performed under pressure, on surface equipment, when the cable 11 is still in the wellbore 6.

In one or more embodiments, a bottom hole assembly (BHA) 18 is attached to an end of the cable 11 before entering the wellhead 9. The BHA 18 includes the SWL tool 200 positioned at the lowermost depth of the cable 11 within the wellbore 6. The SWL tool 200 allows for selective sampling of both fluids and formation characteristics for a more accurate representation of downhole parameters in the wellbore 6. Additionally, the BHA 18 may include various other downhole tools for conducting downhole completion operations. Additionally, the cable 11 may include packers 19 to seal an annulus between the wellbore 6 and the cable 11 to direct flow into the BHA 18.

As fluids are produced from the target reservoir 5, the fluids will flow upwards (see arrow F) through the SWL tool 200. For example, the produced fluids may flow through the spinner (209) thereby rotating the blade type device (209*a*) to measure a flow rate. Additionally, the produced fluids may flow the bore (207*a*) of the flowmeter (207) to measure the volume of fluid and the flow rate. Further, the sensor sub (206) is measuring various parameters of the produced fluids via the gamma ray sensors, pressure sensors, temperature sensors, fluid density (radioactive or inertial) sensors, casing collar locator (CCL) sensors, and other type of sensors to provide production logging data.

Figure 4:
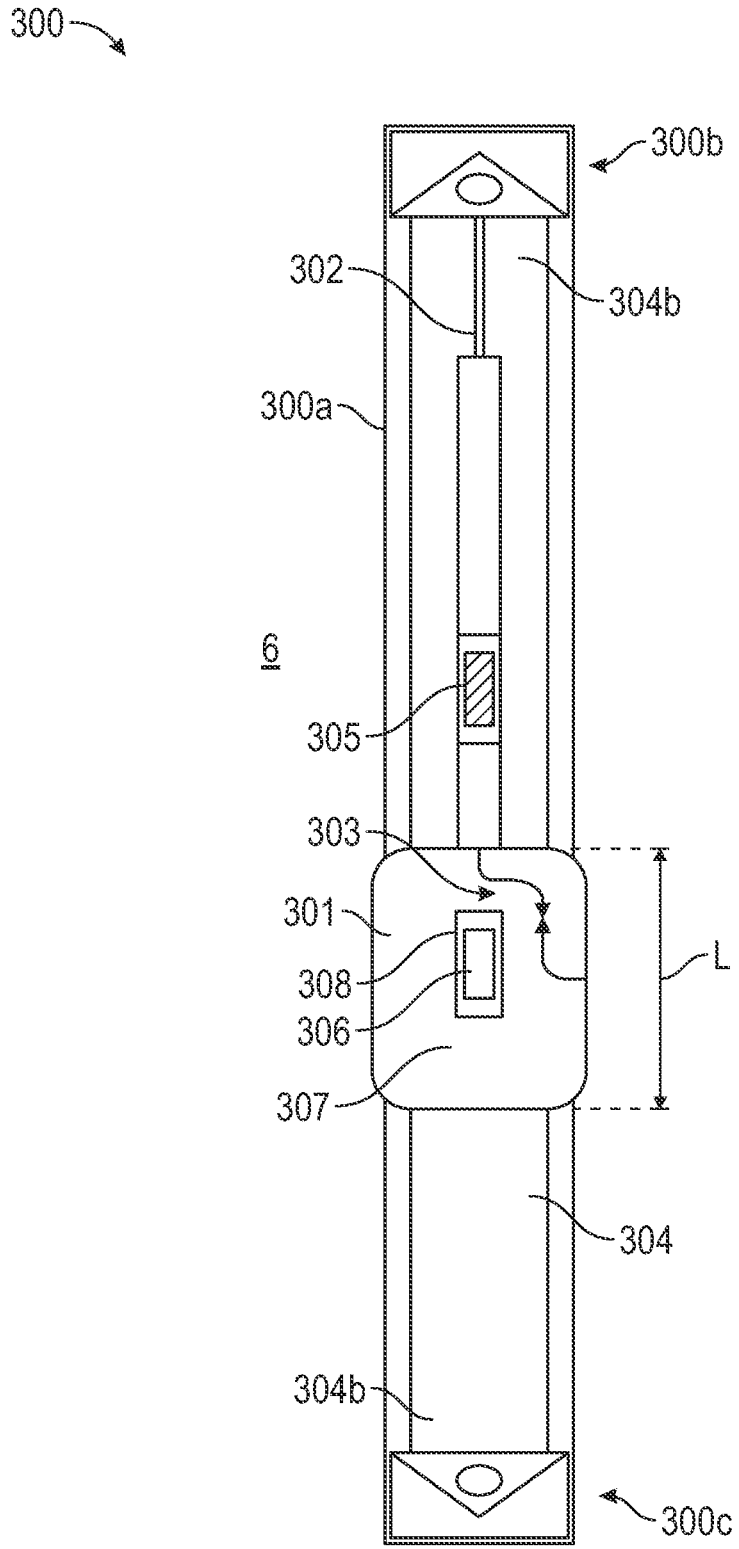
Figure 5:
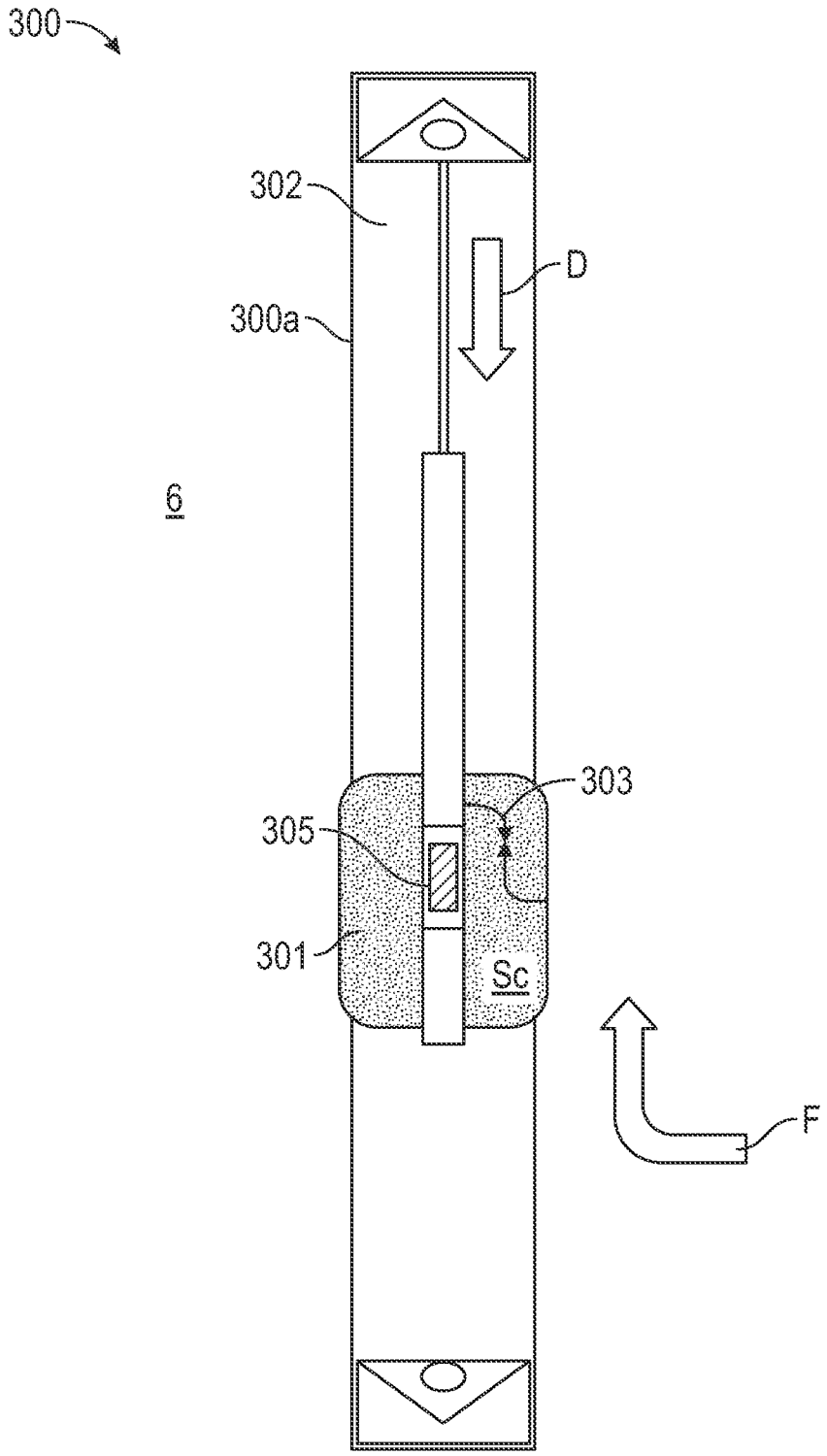
Figure 6:
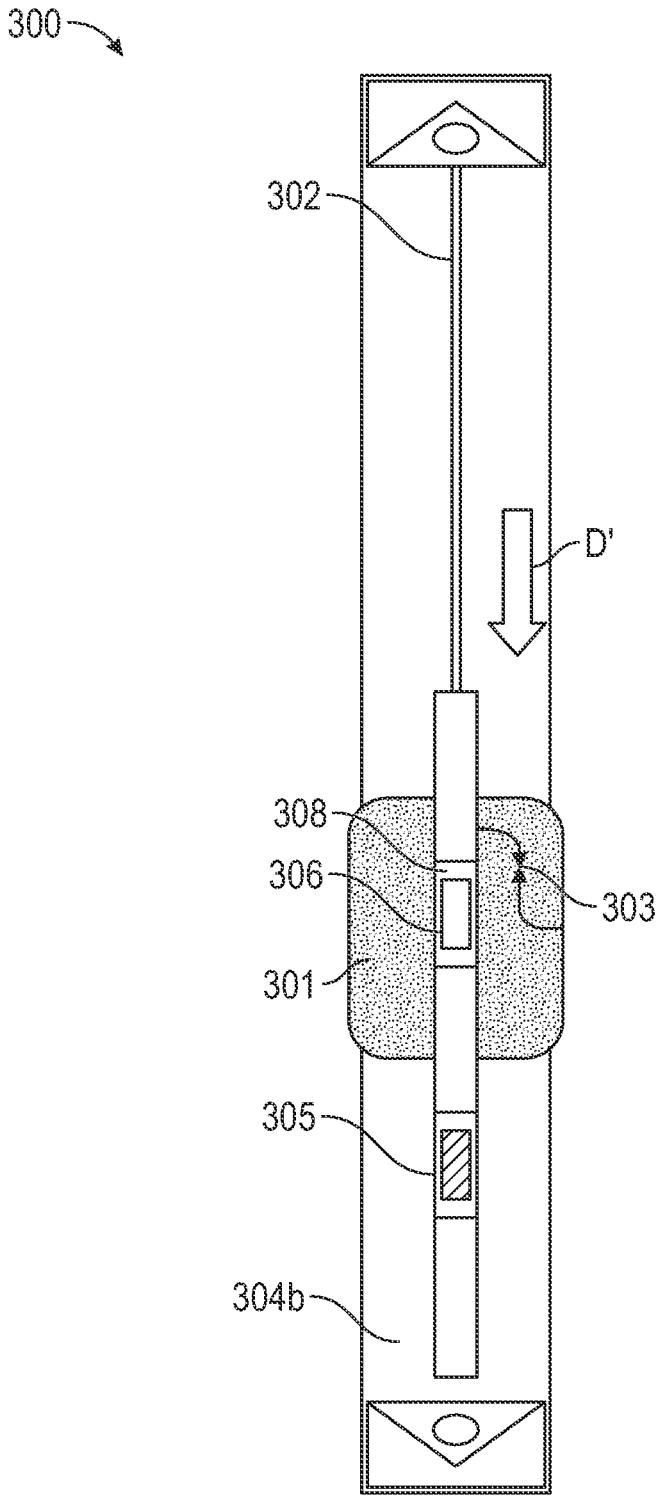

Now referring to FIGS. 4-6, a close-up view of the sample collector sub 300 in the wellbore 6 of the FIG. 3 is illustrated. As shown in FIG. 4, the sample collector sub 300 is deployed in the wellbore 6 at an initial position as described above in FIG. 2. For example, the piston 302 is a first position (i.e., the initial position) in the first hollow zone 304*a* above the sample chamber 301. Additionally, the opening 306 of the sample chamber 301 is in a closed positioned.

Once the SWL tool (200) has reached a predetermined depth, the user may begin a cycle of the sample collector sub 300, as shown in FIG. 5. [For example, the piston 302 receives a predetermined voltage to acuate to move downward (see arrow D) to a second position. As the piston 302 moves downward, the gate 305 moves in front of the opening (306). With the gate 305 in front of the opening (306), a differential pressure between the atmospheric and bottomhole pressure is formed to cause the produced reservoir fluids (see arrow F) to rush into the sample chamber 301. In some embodiments, a pressure within the sample chamber 301 may be set at atmospheric pressure (14.7 psig) to avoid any issues from low bottomhole pressure. The produced reservoir fluids will continue to fill a volume (see Sc) of the sample chamber 301. Additionally, the at least one probe 303 will continuously monitor and transmit the fluids being filled in the sample chamber 301.

Now referring to FIG. 6, once the sample chamber 301 is filled, the at least one probe 303 will transmit a signal to the surface indicating that a full volume of the sample chamber 301 is filled. At the surface, a second predetermined voltage will be sent to actuate the piston 302 to move further downward (see arrow D') to a third position. With the second predetermined voltage, the piston 302 will move the gate 305 off the opening 306 and to the second hollow zone 304*b*. With the gate 205 off the opening, the piston 302 moves the sealing element 308 to seal the opening 306 from receiving further fluids.

In one or more embodiments, after the piston 302 has moved to the third position, the at least one probe 303 may transmit a signal indicating that the sample chamber 301 is sealed. With the sample chamber 301, the cable (11) may be pulled upward to retrieve the SWL tool (200) at the surface to collect the fluid sample in the sample chamber 301. In some embodiments, the sample chamber 301 is removed from the sample collector sub 300 and sent to a lab for analysis as a pressurized sample. Additionally, the sample chamber 301 may be vented to ensure no unsafe compromises are in place once the sample is analyzed.

Figure 7:
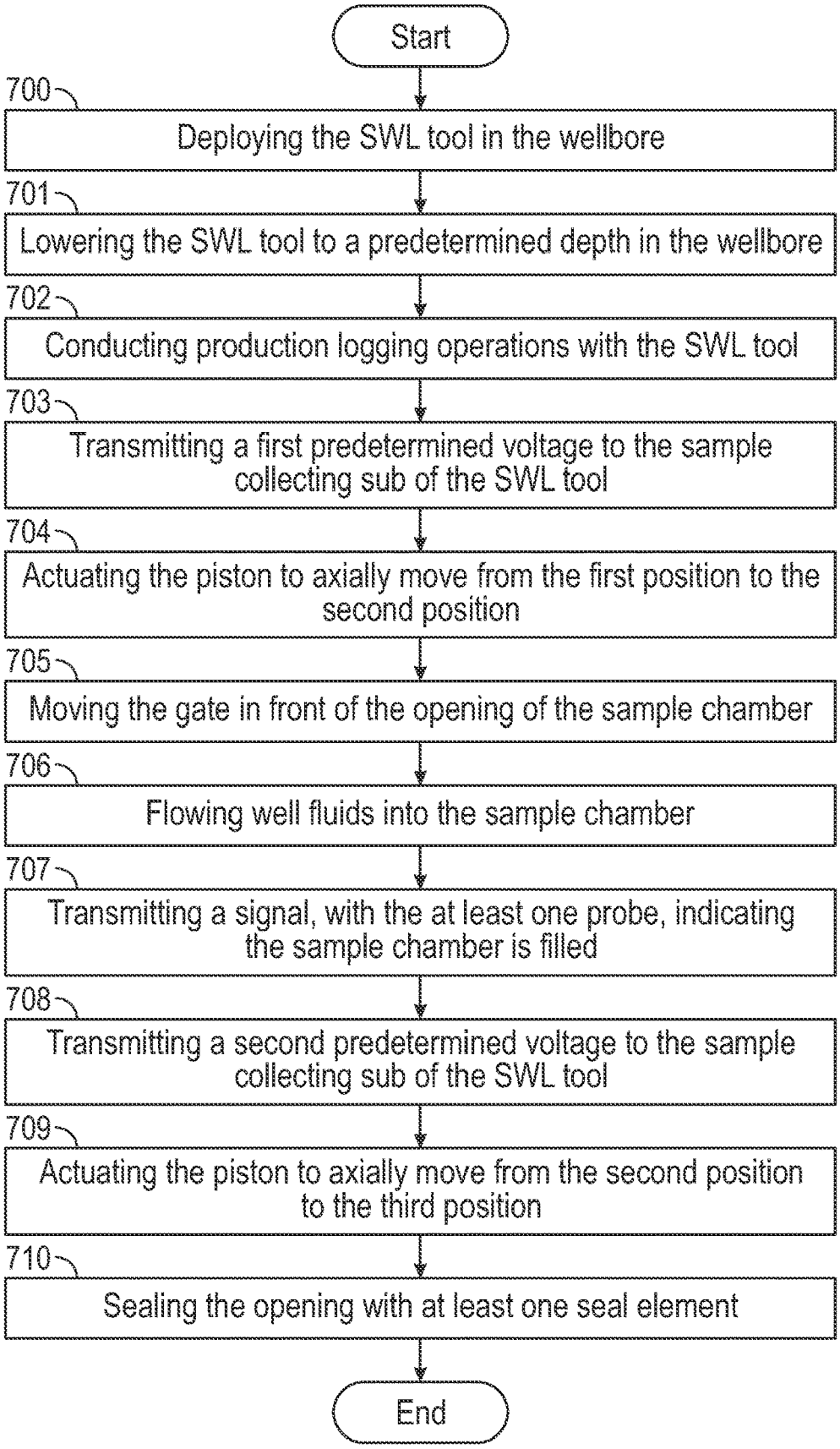
FIG. 7 shows a flowchart in accordance with one or more embodiments of the present disclosure.

Referring to FIG. 7 illustrates a flowchart for using the SWL tool (200) in a well. One or more steps in FIG. 7 may be performed by one or more components (for example, the computing system coupled to a controller in communication with the SWL tool (200)) as described in FIGS. 1-6. For example, a non-transitory computer readable medium may store instructions on a memory coupled to a processor such that the instructions include functionality for the SWL tool (200).

In step 700, the SWL tool is deployed in the wellbore. For example, the SWL tool is attached to an end of a cable and is lowered through the wellhead at the surface of the wellhead. Additionally, the cable may be a wireline, slickline, coiled tubing, or electric line to lower and provide power to the SWL tool at a depth in the wellbore.

In step 701, the SWL tool is lowered to a predetermined depth in the wellbore. For example, the predetermined depth may be an area of interest in the wellbore to gather reservoir parameters. Additionally, the predetermined depth may be a depth in the wellbore when the SWL tool comes in to contact with fluids produced from a target reservoir.

In step 702, with the SWL tool at the predetermined depth, the SWL tool conducts production logging operations. For example, fluids in the wellbore rotate the blade type device of spinner in the SWL tool to measure a flow rate. Additionally, the flowmeter of the SWL tool measures the volume of fluid and the flow rate flowing through the bore of the flowmeter. Further, various parameters of fluids are measured by the sensor sub of the SWL tool. For example. gamma ray sensors, pressure sensors, temperature sensors, fluid density (radioactive or inertial) sensors, casing collar locator (CCL) sensors, and other type of sensors measure various parameters of the fluids and formation at the predetermined depth. The measurements taken form the SWL tool may be stored and transmitted to the surface to form the production logging data.

In step 703, simultaneously to the production logging operations, the first predetermined voltage is transmitted to the sample collector sub of the SWL tool. For example, at the surface, a power system transmits the first predetermined voltage down the cable to the SWL tool. In the SWL tool, the first predetermined voltage travels through an electric connection of the SWL tool.

In step 704, with the first predetermined voltage, the piston of the sample collector sub is actuated to move axially from a first position to a second position. For example, the piston axially moves downward from the first hollow zone of the sample collector sub to the sample chamber.

In step 705, with the piston in the second position, the gate moves in front of the opening of the sample chamber. For example, the gate is coupled to an end of the piston adjacent to the sample chamber such that the gate is positioned over the opening.

In step 706, with the gate over the opening, well fluids flow into the sample chamber via the opening. For example, a differential pressure between the atmospheric and bottomhole pressure is formed from the gate to cause the well fluids to rush into the sample chamber via the opening.

In step 707, when the sample chamber is filled with the well fluids, the at least one probe transmits a signal that the sample chamber is filled. For example, the at least one probe continuously monitors a volume of the sample chamber as it fills. Once the volume of the sample chamber is filled, the at least one probe sends a signal to the surface to indicate that the sample chamber is filled.

In step 708, with the signal received, the second predetermined voltage is transmitted to the sample collector sub of the SWL tool. For example, at the surface, the power system transmits the second predetermined voltage down the cable to the SWL tool. In the SWL tool, the second predetermined voltage travels through the electric connection of the SWL tool.

In step 709, with the second predetermined voltage, the piston of the sample collector sub is actuated to move axially from the second position to a third position. For example, the piston axially moves further downward to the second hollow zone to have the gate no longer cover the opening of the sample chamber.

In step 710, with the piston moved to the third position, the opening is sealed with the at least one sealing element. For example, the piston moves the at least one sealing element to cover the opening thereby sealing the sample chamber. With the sample chamber sealed, the at least one probe may transmit another signal to indicate that the at least one sealing element has sealed the sample chamber. The cable may then be pulled upward to retrieve the SWL tool and collect the well fluids sealed in the sample chamber. The collected well fluids may then be sent to a lab for analysis.

In addition to the benefits described, the systems and methods disclosed herein may improve an overall efficiency and performance of production logging operations and fluid sampling operations at a well site while reducing cost. Additionally, the sample while logging (SWL) tool disclosed herein may provide accurate data of hydrocarbon and water producing zones in real time, collect downhole reservoir fluid samples, and determine various fluid parameters such as fluid type, composition, density, viscosity, porosity, and other characteristics.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A sample while logging tool for downhole fluid sampling and production logging, the sample while logging tool comprising:

a sample collector sub, the sample collector sub comprising:

a body defining a bore extending from a first end to a second end;

one or more sample chambers housed in the bore, wherein the sample chamber is configured to collect a fluid sample;

at least one probe coupled to the sample chamber to measure fluid properties of the collected fluid sample within the sample chamber and transmit the fluid properties; and a piston coupled to the first end having a gate distal to the first end, wherein the piston is actuated to open and close an opening of the sample chamber, the piston comprising:

a first position when the piston is initially positioned in a first hollow zone of the bore above the sample chamber;

a second position when the piston is actuated by a first predetermined voltage to axially move downward and opening the opening of the sample chamber; and a third position when the piston is actuated by a second predetermined voltage to axially move further downward and close the opening of the sample chamber; and a sensor sub coupled to the sample collector sub and configured to measure and transmit data on fluids within a well to form production logging data, wherein the sensor sub comprises at least one gamma ray sensor, pressure sensor, temperature sensor, fluid density sensor, or casing collar locator sensor.

2. The sample while logging tool of claim 1, wherein the gate is positioned by the piston in front of the opening in the second position.

3. The sample while logging tool of claim 1, wherein the gate is positioned by the piston in a second hollow zone of the bore below the sample chamber wherein the piston is in the third position.

4. The sample while logging tool of claim 3, wherein at least one sealing element is moved by the piston to seal the opening in the third position.

5. The sample while logging tool of claim 4, wherein at least one sealing element is an elastomer seal or O-ring.

6. The sample while logging tool of claim 1, further comprising at least one flowmeter coupled below the sensor sub, wherein the at least one flowmeter is a spinner flowmeter or an inline flowmeter.

7. The sample while logging tool of claim 1, further comprising at least one centralizer.

8. The sample while logging tool of claim 1, further comprising a connector to couple the sample while logging tool to a cable.

9. A system, comprising:

a wellhead on a surface of a wellbore;

a wireline extending downward into the wellbore from the wellhead; and a bottom hole assembly coupled to a lowermost end of the wireline, the bottom hole assembly comprises:

a connector coupled to the wireline;

a sample collector sub, wherein the sample collector sub comprises one or more sample chambers, at least one probe coupled to the sample chamber, and a piston operationally coupled to the sample chamber, wherein the piston is configured to open and close an opening of the sample chamber;

wherein the sample collector sub collects a well fluid sample; and a sensor sub coupled to the sample collector sub, wherein the sensor sub comprises at least one gamma ray sensor, pressure sensor, temperature sensor, fluid density sensor, or casing collar locator sensor, wherein the sensor sub measures and transmits data on fluids within the wellbore to form production logging data;

wherein the at least one probe cross correlates the collected well fluid sample and the production logging data.

10. The system of claim 9, wherein the piston is actuated from a first position to a second position to move a gate in front of an opening of the sample chamber to form a differential pressure between an atmospheric pressure in the sample chamber and a bottomhole pressure in the wellbore.

11. The system of claim 9, wherein the wireline is coupled to a computer system at the surface.

12. The system of claim 9, wherein the connector is a rope socket connector.

13. A method for using a sample while logging tool, the method comprising:

conducting production logging operations with the sample while logging tool in a wellbore;

actuating a piston within the sample collector sub of the sample while logging to axially move downward;

covering an opening of a sample chamber of the sample collector sub with a gate coupled to the piston to form a differential pressure between an atmospheric pressure in the sample chamber and a bottomhole pressure in the wellbore;

flowing well fluids into the opening and filling the sample chamber with the well fluids;

transmitting a signal, with at least one probe coupled to the sample chamber, indicating the sample chamber is filled;

further actuating the piston to move past the sample chamber to close the opening; and retrieving the sample chamber at the surface to collect the well fluids.

14. The method of claim 13, wherein actuating the piston comprises transmitting a first predetermined voltage down a wireline to the piston.

15. The method of claim 13, further comprising sealing the opening with at least one sealing element.

16. The method of claim 13, further comprising pulling a wireline coupled to the sample while logging tool to retrieve the sample chamber at the surface.

17. The method of claim 13, wherein conducting production logging operations with the sample while logging tool comprises measuring and transmitting data on fluids within the wellbore with at least one gamma ray sensor, pressure sensor, temperature sensor, fluid density sensor, or casing collar locator sensor of a sensor sub coupled to the sample collector sub.

* * * * *